US011299385B2

(12) United States Patent
Shen

(10) Patent No.: US 11,299,385 B2
(45) Date of Patent: Apr. 12, 2022

(54) MULTIPLE-PIECE VACUUM-INSULATED HEATING TANK OF WATER DISPENSER

(71) Applicant: SUZHOU OASIS ELECTRONIC CO., LTD., Jiangsu (CN)

(72) Inventor: Yu-Chun Shen, Jiangsu (CN)

(73) Assignee: SUZHOU OASIS ELECTRONIC CO., LTD., Jiangsu (CN)

( * ) Notice: Subject to any disclaimer, the term of this patent is extended or adjusted under 35 U.S.C. 154(b) by 84 days.

(21) Appl. No.: 16/940,559

(22) Filed: Jul. 28, 2020

(65) Prior Publication Data

US 2022/0033243 A1 Feb. 3, 2022

(51) Int. Cl.
*B67D 1/08* (2006.01)

(52) U.S. Cl.
CPC .. *B67D 1/0895* (2013.01); *B67D 2210/00044* (2013.01); *B67D 2210/00102* (2013.01); *B67D 2210/00146* (2013.01)

(58) Field of Classification Search
CPC ..... F24D 3/085; F24D 15/02; F24H 1/181; F24H 1/182; F24H 1/183; F24H 1/122; F24H 1/125; F24H 1/127; B67D 2210/00044; B67D 2210/00102; B67D 2210/00146; B67D 7/80; B67D 7/82; B67D 1/0895; B05C 5/001; B05C 11/1042; B05C 17/00523; B05C 17/00546
USPC ..... 222/146.1, 146.2; 126/610, 617; 122/19.2; 237/56
See application file for complete search history.

(56) References Cited

U.S. PATENT DOCUMENTS 2,852,462 A * 9/1958 Andrus ..... C23F 13/06 205/735
6,612,268 B1 * 9/2003 Peteri ..... F24H 1/182 122/19.2

* cited by examiner

*Primary Examiner* — Vishal Pancholi
*Assistant Examiner* — Robert K Nichols, II
(74) *Attorney, Agent, or Firm* — Juan Carlos A. Marquez; Marquez IP Law Office, PLLC

(57) ABSTRACT

A multiple-piece vacuum-insulated heating tank for use in a water dispenser includes a threaded cover, a thermal insulation cover, and a heating tank body. The threaded cover is mounted on an upper opening of the heating tank body and includes a plastic cover and a protective cover mounted on and around the plastic cover. The thermal insulation cover is fitted in the upper opening and includes an upper cover and a lower cover. The lower cover is cup-shaped; is mounted with a heating tube, a water inlet pipe, a water outlet pipe, a thermowell, a temperature-sensing heat pipe, a heat collector block, and two snap-action thermostats at the bottom side; and has a sidewall formed with a step adjacent to the bottom side. The heating tank not only has a multiple-piece structure that facilitates mass production and maintenance, but also dispenses with electronic temperature control as is conventionally required.

10 Claims, 2 Drawing Sheets

MULTIPLE-PIECE VACUUM-INSULATED HEATING TANK OF WATER DISPENSER

BACKGROUND OF THE INVENTION

1. Technical Field

The present invention relates to the field of water dispenser manufacture and more particularly to a multiple-piece vacuum-insulated heating tank for use in a water dispenser.

2. Description of Related Art

The major disadvantages of the existing vacuum-insulated heating tanks of water dispensers are as follows: 1) A one-piece soldered structure is used; i.e., components such as the water inlet pipe, the water outlet pipe, and the heating tube are all soldered to the heating tank body to form a single unit. While the one-piece design advantageously reduces the chance of water leakage, the downside is that such a heating tank will have to be discarded as a whole should the heating tube be damaged or any of the pipes leak. 2) Temperature is detected electronically. As the heat inside a vacuum-insulated heating tank will not be conducted to and through the outer wall of the heating tank rapidly, the traditional snap-action bimetallic-strip thermostats cannot be used. Instead, a thermowell must be soldered to the heating tank body so that an electronic temperature sensor can be inserted into the thermowell. Nevertheless, the direct-current power source and electronic circuit required for measuring and controlling temperature with the electronic temperature sensor cause an increase in cost and system complexity. 3) Continued from 2), now that a snap-action bimetallic-strip thermostat cannot be mounted on the body of a vacuum-insulated heating tank to prevent the heating tank from dry boiling, there is no other way than to change the bottom portion of the heating tank into a single-layer structure where an anti-dry boiling thermostat can be mounted. The single-layer bottom, however, increases the heat dissipation area of the heating tank and thus compromises the effect of vacuum insulation.

BRIEF SUMMARY OF THE INVENTION

The technical problem that the present invention aims to solve is to provide a multiple-piece vacuum-insulated heating tank for use in a water dispenser, wherein the heating tank has a multiple-piece structure that overcomes the prior art drawback that a vacuum-insulated heating tank must employ electronic temperature control.

To solve the aforesaid technical problem, the technical solution adopted by the present invention consists in a multiple-piece vacuum-insulated heating tank for use in a water dispenser. The multiple-piece vacuum-insulated heating tank includes a threaded cover, a thermal insulation cover, and a heating tank body. The threaded cover is mounted on an upper opening of the heating tank body. The upper opening of the heating tank body is formed with an external thread. The thermal insulation cover is fitted in the upper opening of the heating tank body. The heating tank body is a double-layer cup-shaped structure, has a bottom portion mounted with a drain pipe, and is provided with a circular projection adjacent to an opening.

The threaded cover is composed of a plastic cover and a protective cover. The plastic cover is in the form of a hat. The plastic cover and the protective cover are formed with identical openings in their respective surfaces. The plastic cover has a lower portion provided with an internal thread. The protective cover is mounted on and around the plastic cover.

The thermal insulation cover is composed of an upper cover and a lower cover. The lower cover is a cup-shaped structure and has a bottom side mounted with a heating tube, a water inlet pipe, a water outlet pipe, a thermowell, a temperature-sensing heat pipe, a heat collector block, and two snap-action thermostats. The temperature-sensing heat pipe has one end inserted into the thermowell and the other end inserted into the heat collector block. The two snap-action thermostats are mounted on a top side and a lateral side of the heat collector block respectively. The upper cover is a flat plate and has an upper side provided with a wiring hole and a foam material injection hole. The space between the upper cover and the lower cover is filled with a thermal insulation layer. The sidewall of the lower cover is formed with a step adjacent to the bottom side.

In one preferred embodiment of the present invention, a vacuum layer is formed between the inner layer and the outer layer of the heating tank body.

In one preferred embodiment of the present invention, the drain pipe extends through the vacuum layer.

In one preferred embodiment of the present invention, the plastic cover is threadedly connected to the upper opening of the heating tank body.

In one preferred embodiment of the present invention, the two snap-action thermostats are a temperature-controlling thermostat and an anti-dry boiling thermostat.

In one preferred embodiment of the present invention, the temperature-controlling thermostat is mounted on the top side of the heat collector block.

In one preferred embodiment of the present invention, the anti-dry boiling thermostat is mounted on the lateral side of the heat collector block.

In one preferred embodiment of the present invention, the thermal insulation layer is made of a polyurethane (PU) foam material.

In one preferred embodiment of the present invention, the water outlet pipe and the water inlet pipe penetrate the thermal insulation cover and the threaded cover.

In one preferred embodiment of the present invention further comprise a sealing ring mounted in a space surrounded by the step and the circular projection.

The advantageous effects of the present invention are as follows: The multiple-piece vacuum-insulated heating tank disclosed herein for use in a water dispenser has a multiple-piece structure that facilitates mass production and maintenance. The temperature measurement, temperature control, and dry boiling prevention methods used by the multiple-piece vacuum-insulated heating tank are based on a combination of the heat pipe and the snap-action thermostats (which combination can be viewed as an upgraded snap-action temperature control device that depends on heat transfer through a conventional medium) and have therefore completely overcome the prior art drawback that a vacuum-insulated heating tank must use electronic temperature control.

BRIEF DESCRIPTION OF THE SEVERAL VIEWS OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
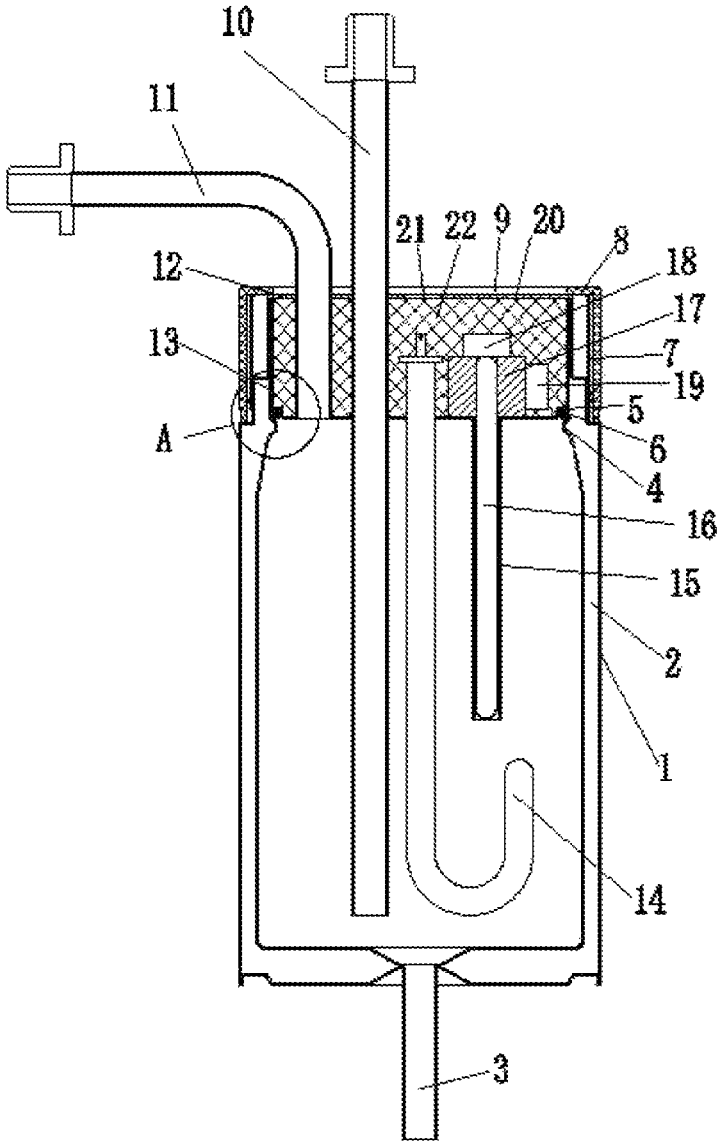
FIG. 1 is a structural diagram of a multiple-piece vacuum-insulated heating tank for use in a water dispenser.
Figure 2:
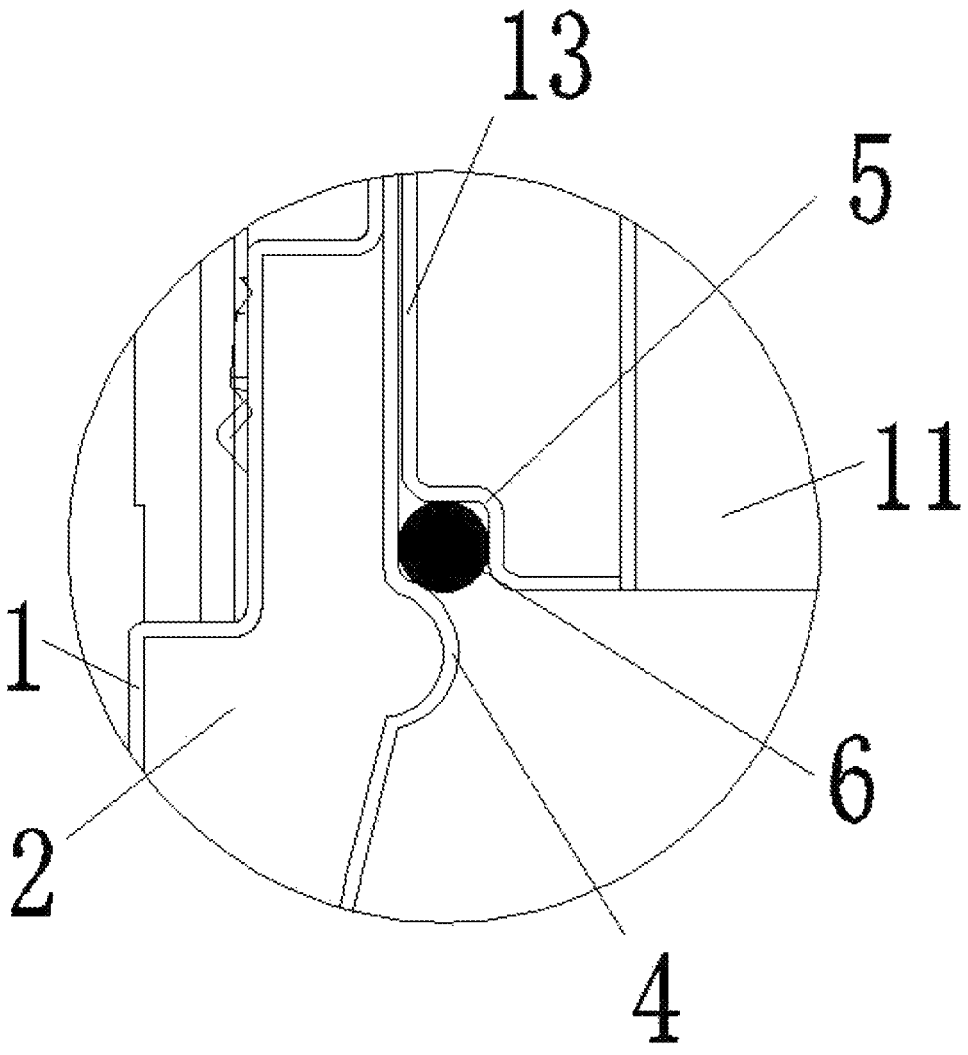
FIG. 2 is an enlarged view of the circled area A of the multiple-piece vacuum-insulated heating tank in FIG. 1.

Referring to FIG. 1 and FIG. 2, a multiple-piece vacuum-insulated heating tank for use in a water dispenser includes a threaded cover, a thermal insulation cover, and a heating tank body 1. The threaded cover is mounted on an upper opening of the heating tank body 1. The upper opening of the heating tank body 1 is formed with an external thread. The thermal insulation cover is fitted in the upper opening of the heating tank body 1. The heating tank body 1 is a double-layer cup-shaped structure, with a vacuum layer 2 formed between the inner layer and the outer layer of the heating tank body 1. The vacuum layer 2 provides thermal insulation.

A drain pipe 3 is mounted at a bottom portion of the heating tank body 1. The drain pipe 3 extends through the vacuum layer 2.

A circular projection 4 is provided on the heating tank body 1 at a position adjacent to openings 9. The circular projection 4 is configured to work with a step 5 so as to produce a position-limiting effect on a sealing ring 6.

The threaded cover is composed of a plastic cover 7 and a protective cover 8. The plastic cover 7 is shaped as a hat. The plastic cover 7 and the protective cover 8 are formed with identical openings 9 in their respective surfaces. The openings 9 are smaller in size than an upper cover 12 of the thermal insulation cover so that the threaded cover can hold the thermal insulation cover in place while allowing a water inlet pipe 10 and a water outlet pipe 11 to be easily exposed from an upper surface of the threaded cover.

An internal thread is provided on a lower portion of the plastic cover 7. The plastic cover 7 and the upper opening of the heating tank body 1 are connected by threads such that the plastic cover 7 is tightly connected to the heating tank body 1.

The protective cover 8 is mounted on and around the plastic cover 7. The protective cover 8 is used to protect the plastic cover 7.

The thermal insulation cover is composed of the upper cover 12 and a lower cover 13. The lower cover 13 is a cup-shaped structure. A heating tube 14, a thermowell 15, a temperature-sensing heat pipe 16, a heat collector block 17, and two snap-action thermostats as well as the water inlet pipe 10 and the water outlet pipe 11 are mounted at a bottom side of the lower cover 13. The water outlet pipe 11 and the water inlet pipe 10 penetrate the thermal insulation cover and the threaded cover.

One end of the temperature-sensing heat pipe 16 is inserted into the thermowell 15, and the other end into the heat collector block 17. The two snap-action thermostats are mounted on a top side and a lateral side of the heat collector block respectively. The two snap-action thermostats are a temperature-controlling thermostat 18 and an anti-dry boiling thermostat 19. The temperature-controlling thermostat 18 is mounted on the top side of the heat collector block while the anti-dry boiling thermostat 19 is mounted on the lateral side of the heat collector block. As soon as the temperature of the top side of the heat collector block 17 reaches the activating temperature of the temperature-controlling thermostat 18, the temperature-controlling thermostat 18 will be activated to break the heating circuit. When dry boiling takes place in the heating tank and the temperature of the lateral side of the heat collector block 17 reaches the activating temperature of the anti-dry boiling thermostat 19, the anti-dry boiling thermostat 19 will be activated at once to break the heating circuit if the temperature-controlling thermostat 18 has not done so in advance.

The upper cover 12 is a flat plate. A wiring hole 20 and a foam material injection hole 21 are provided in an upper side of the upper cover 12. The space between the upper cover 12 and the lower cover 13 is filled with a thermal insulation layer 22. The thermal insulation layer 22 is made of a polyurethane (PU) foam material. Once the upper cover 12 and the lower cover 13 are separately made, the upper cover 12 is pressed tightly on the lower cover 13 from above, and the PU foam material is injected through the foam material injection hole 21 into the space between the upper cover 12 and the lower cover 13. The upper cover 12 and the lower cover 13 are bonded together when the PU foam material solidifies.

The step 5 is formed on the sidewall of the lower cover 13 at a position adjacent to the bottom side of the lower cover 13. The sealing ring 6 is mounted in the space surrounded by the step 5 and the circular projection 4. The sealing ring 6 provides a tight seal between the thermal insulation cover and the heating tank body 1.

To assemble the multiple-piece vacuum-insulated heating tank for use in a water dispenser, the first step is to mount the sealing ring 6 around the step 5 at a lower portion of the thermal insulation cover. Then, the thermal insulation cover is fitted into the upper opening of the heating tank body 1, before the plastic cover 7 is screwed tightly on the heating tank body 1 to hold the thermal insulation cover in place. The last step is to mount the protective cover 8 on and around the plastic cover 7.

According to the present invention, the heating tank is divided into three parts: the threaded cover, the thermal insulation cover, and the heating tank body 1. The thermal insulation cover and the heating tank body 1 are connected via the threaded cover. The drain pipe 3 is provided at the bottom portion of the heating tank body 1, while the heating tube 14, the water inlet pipe 10, the water outlet pipe 11, the thermowell 15, the temperature-sensing heat pipe 16, the heat collector block 17, and the snap-action thermostats are all provided on or in the thermal insulation cover. This allows the heating tube 14 to be replaced and repaired when damaged, without affecting vacuum insulation of the heating tank body 1.

The temperature-sensing heat pipe 16 is used as a temperature-sensing element. A head portion of the temperature-sensing heat pipe 16 is inserted into the thermowell 15 and hence into the heating tank body 1 in order to measure water temperature directly. A tail portion of the temperature-sensing heat pipe 16 is inserted into the heat collector block 17. The two snap-action thermostats that are respectively used to control water temperature and prevent dry boiling are mounted on the top side and the lateral side of the heat collector block 17 respectively. While the heating tank is heating, the heat absorbed by the temperature-sensing heat pipe 16 from the heated water is transmitted to the heat collector block 17 rapidly. When the temperature of the top side of the heat collector block 17 reaches the activating temperature of the temperature-controlling thermostat 18, the temperature-controlling thermostat 18 will be activated immediately to break the heating circuit. Should dry boiling take place in the heating tank and the temperature of the lateral side of the heat collector block 17 reach the activating temperature of the anti-dry boiling thermostat 19, the anti-dry boiling thermostat 19 will be activated at once to break the heating circuit if the temperature-controlling thermostat 18 has not done so beforehand. As the temperature-sensing heat pipe 16 transmits heat through evaporation and condensation and therefore has far higher heat transfer efficiency than common medium materials, the temperature control device composed of the temperature-sensing heat pipe 16 and the snap-action thermostats is a sensitive heavy-current control device that does not require any electronic circuit or direct-current power source, that can overcome all the prior art drawbacks associated with temperature measurement and control through an electronic circuit, and that can carry out water temperature control and dry boiling prevention in a rapid and accurate manner.

In contrast to the prior art, the multiple-piece vacuum-insulated heating tank disclosed herein for use in a water dispenser has a multiple-piece structure that facilitates mass production and maintenance. Moreover, the temperature measurement, temperature control, and dry boiling prevention methods used by the multiple-piece vacuum-insulated heating tank are based on a combination of the heat pipe and the snap-action thermostats (which combination can be viewed as an upgraded snap-action temperature control device that depends on heat transfer through a conventional medium) and have therefore completely overcome the prior art drawback that a vacuum-insulated heating tank must use electronic temperature control. The all-heavy-current structure also features enhanced safety, high reliability, and low cost.

It should be pointed out that in the foregoing description of the present invention, any directional or positional relationship indicated by such a term as "upper", "lower", "left", "right", "inner", or "outer" is based on either the directional or positional relationship shown in the accompanying drawings, or the directional or positional relationship that can be identified when a product according to the invention is placed in a conventional manner. Those terms should not be construed as limitations of the invention because they are used only to facilitate and simplify description of the invention, but not to specify or imply that the device or element referred to must be positioned, constructed, or operated in a certain direction.

The above description is only the preferred embodiments of the present invention and is not intended to limit the present invention in any form. Although the invention has been disclosed as above in the preferred embodiments, they are not intended to limit the invention. A person skilled in the relevant art will recognize that equivalent embodiment modified and varied as equivalent changes disclosed above can be used without parting from the scope of the technical solution of the present invention. All the simple modification, equivalent changes and modifications of the above embodiments according to the material contents of the invention shall be within the scope of the technical solution of the present invention.

What is claimed is:

1. A multiple-piece vacuum-insulated heating tank of a water dispenser, comprising a threaded cover, a thermal insulation cover, and a heating tank body, wherein the threaded cover is mounted on an upper opening of the heating tank body, the upper opening of the heating tank body is formed with an external thread, the thermal insulation cover is fitted in the upper opening of the heating tank body, the heating tank body is a double-layer cup-shaped structure, the heating tank body has a bottom portion mounted with a drain pipe, and the heating tank body is provided with a circular projection adjacent to an opening;

wherein the threaded cover is composed of a plastic cover and a protective cover, the plastic cover is hat-shaped, a surface of the plastic cover and a surface of the protective cover are formed with identical said openings respectively, the plastic cover has a lower portion provided with an internal thread, and the protective cover is mounted on and around the plastic cover;

wherein the thermal insulation cover is composed of an upper cover and a lower cover; the lower cover is a cup-shaped structure; the lower cover has a bottom side mounted with a heating tube, a water inlet pipe, a water outlet pipe, a thermowell, a temperature-sensing heat pipe, a heat collector block, and two snap-action thermostats; the temperature-sensing heat pipe has one end inserted into the thermowell and an opposite end inserted into the heat collector block; the two snap-action thermostats are mounted on a top side and a lateral side of the heat collector block respectively; the upper cover is a flat plate; the upper cover has an upper side provided with a wiring hole and a foam material injection hole; a space between the upper cover and the lower cover is filled with a thermal insulation layer; and the lower cover has a sidewall formed with a step adjacent to the bottom side.

2. The multiple-piece vacuum-insulated heating tank of a water dispenser as claimed in claim 1, wherein the heating tank body has an inner layer, an outer layer, and a vacuum layer between the inner layer and the outer layer.

3. The multiple-piece vacuum-insulated heating tank of a water dispenser as claimed in claim 2, wherein the drain pipe extends through the vacuum layer.

4. The multiple-piece vacuum-insulated heating tank of a water dispenser as claimed in claim 1, wherein the plastic cover is threadedly connected to the upper opening of the heating tank body.

5. The multiple-piece vacuum-insulated heating tank of a water dispenser as claimed in claim 1, wherein the two snap-action thermostats are a temperature-controlling thermostat and an anti-dry boiling thermostat.

6. The multiple-piece vacuum-insulated heating tank of a water dispenser as claimed in claim 5, wherein the temperature-controlling thermostat is mounted on the top side of the heat collector block.

7. The multiple-piece vacuum-insulated heating tank of a water dispenser as claimed in claim 5, wherein the anti-dry boiling thermostat is mounted on the lateral side of the heat collector block.

8. The multiple-piece vacuum-insulated heating tank of a water dispenser as claimed in claim 1, wherein the thermal insulation layer is made of a polyurethane (PU) foam material.

9. The multiple-piece vacuum-insulated heating tank of a water dispenser as claimed in claim 1, wherein the water outlet pipe and the water inlet pipe penetrate the thermal insulation cover and the threaded cover.

10. The multiple-piece vacuum-insulated heating tank of a water dispenser as claimed in claim 1, further comprising a sealing ring mounted in a space surrounded by the step and the circular projection.

* * * * *